US005713059A

United States Patent [19]

Ishikawa

[11] Patent Number: 5,713,059

[45] Date of Patent: Jan. 27, 1998

[54] PAPER JAM DETECTOR FOR ELECTROPHOTOGRAPHIC PRINTER

[75] Inventor: Yutaka Ishikawa, Tokyo, Japan

[73] Assignee: Asahi Kogaku Kogyo Kabushiki Kaisha, Tokyo, Japan

[21] Appl. No.: 620,350

[22] Filed: Mar. 22, 1996

[30] Foreign Application Priority Data

Mar. 25, 1995 [JP] Japan ..... 7-091459

[51] Int. Cl.[6] ..... G03G 15/00

[52] U.S. Cl. ..... 399/18; 226/26; 226/45; 226/100; 399/21; 399/384; 399/400

[58] Field of Search ..... 399/21, 22, 400, 399/18, 23, 384, 397; 271/227, 242, 258.01; 226/45, 26, 100

[56] References Cited

U.S. PATENT DOCUMENTS 4,025,187 5/1977 Taylor et al. ..... 399/21 X
4,924,266 5/1990 Negoro et al. .
4,987,448 1/1991 Chikama .
5,081,487 1/1992 Hoyer et al. ..... 399/397 X
5,365,322 11/1994 Hamada et al. ..... 399/21
5,543,909 8/1996 Quesnel ..... 271/242 X

*Primary Examiner*—S. Lee
*Attorney, Agent, or Firm*—Greenblum & Bernstein, P.L.C.

[57] ABSTRACT

A broad swing arm having a finger at its swinging end extends from an axis near a fixing unit to a tractor, overtop and next to a continuous form transport path. Any bulge or buckle caused by a paper jam and forming in the continuous form at any position between the fixing unit and tractor, and across the width of the form, is detected as the swing arm is pushed up at some point along its length, moving the finger away from a sensor monitored by a controller. Printing in the printer is stopped when the sensor detects that the finger has been moved.

33 Claims, 4 Drawing Sheets

PAPER JAM DETECTOR FOR ELECTROPHOTOGRAPHIC PRINTER

BACKGROUND OF THE INVENTION

The present invention relates to a device for detecting paper jams in an electrophotographic printer employing a continuous form (i.e., fanfold) sheet.

Conventionally, paper jams in electrophotographic continuous form printers may be detected at various specific locations. Normally, to detect the jamming of a continuous form, a push-in type pin actuator is placed near the path of the continuous form at a location along the form transport path, and when the pin actuator is pushed in (tripping a photosensor or the like), a jam is detected. That is, when the continuous form departs from the sheet transport path due to jamming, the form contacts and pushes in the pin actuator. However, in this case, the jam is detected at the particular point where the pin actuator is placed, so that detection of a jam that departs from the form transport path at another location is detected late or is missed entirely. Particularly with electrophotographic printers, if jam detection is late, the recording sheet (the continuous form) continues to advance, and can damage the fixing rollers or other rollers.

SUMMARY OF THE INVENTION

It is therefore an object of the present invention to provide an improved jam detection device capable of detecting jamming of a continuous form along a range of positions of a sheet transport path.

In order to meet the objects of the invention, a jam detector for a sheet transport path of a continuous form electrophotographic printer includes: a detection member extending along the sheet transport path in the direction of sheet transport, the detection member positioned to be pushed away from the sheet transport path by buckling of the continuous form at substantially any position along the detection member; and a movement sensor for sensing movement of the detection member. In this manner, the jam detector is able to detect a jam occurring at various positions along the sheet transport path, as jam-initiated buckling of the continuous form, anywhere along the length of the detection member, will push up the detection member extending along the sheet transport path.

Preferably, the detection member extends substantially parallel to the sheet transport path. Further preferably, the movement sensor senses movement of the detection member when only a portion of the detection member moves away from the sheet transport path. The detection member may be plate-shaped, and preferably covers an entire width of a continuous form.

In one preferred embodiment, the detection member includes: a swing arm having an axis end and extending to a swinging end in a direction parallel to the sheet transport path, the swinging end being swingable away from the sheet transport path; the swing arm positioned to be pushed and swung away from the sheet transport path by buckling of the continuous form at any position from the swinging axis, along the swinging arm, to the swinging end. With this construction, the swinging arm is pushed away from the sheet transport path by any buckling of the continuous form along the entire length of the swinging arm.

In a further development of this embodiment, the movement sensor includes: an actuator finger attached to the swing arm and swingable with the movable arm; and a finger detector, activated by swinging of the actuator finger away from the sheet transport path. In this case, a small movement of the swing arm can be translated into a large enough movement to trigger the movement sensor.

In another development of this embodiment, the swing arm is detachably supported, and detachable from the jam detector when swung to a predetermined position. Accordingly, a jam can be easily attended to by an operator, as the swing arm is easily removed. In this case, the movement detector is preferably activated when the swing arm is detached.

According to another aspect of the invention, a continuous form electrophotographic printer includes: imaging means for forming a toner image on a continuous form; a sheet feeder for feeding the continuous form along a sheet transport path; a fixing unit for fixing the toner image to the continuous form; a detection member extending along the sheet transport path from the fixing unit to the sheet feeder, the detection member being positioned to be pushed away from the sheet transport path by buckling of the continuous form at substantially any position along the detection member from the fixing unit to the sheet feeder; and a movement sensor for sensing movement of the detection member.

In this manner, the electrophotographic printer is able to detect a jam occurring at various positions along the sheet transport path, as jam-initiated buckling of the continuous form, anywhere along the length of the detection member, will push up the detection member extending along the sheet transport path.

Preferably, the printer includes a controller, the controller stopping the sheet feeder and releasing the continuous form from the fixing unit when the movement sensor senses movement of the detection member. Accordingly, the jam is stopped early and without damaging any of the components of the printer, and a jammed form can be easily removed by an operator.

The detection member of the printer preferably extends substantially parallel to the sheet transport path. Further, the movement sensor preferably senses movement of the detection member when only a portion of the detection member moves away from the sheet transport path. Optionally, the detection member may be plate-shaped, and preferably covers an entire width of a continuous form in the printer.

The detection member of one preferred embodiment of the electrophotographic printer includes: a swing arm having an axis end and extending to a swinging end in a direction parallel to the sheet transport path, the swinging end being swingable away from the sheet transport path; the swing arm positioned to be pushed and swung away from the sheet transport path by buckling of the continuous form at any position from the swinging axis, along the swinging arm, to the swinging end. With this construction, the swinging arm is pushed away from the sheet transport path by any buckling of the continuous form along the entire length of the swinging arm.

In a further development of this embodiment, the movement sensor includes: an actuator finger attached to the swing arm and swingable with the movable arm; and a finger detector, activated by swinging of the actuator finger away from the sheet transport path. In this case, a small movement of the swing arm can be translated into a large enough movement to trigger the movement sensor.

In another development of this embodiment, the swing arm is detachably supported, and detachable from the jam detector when swung to a predetermined position. Accordingly, a jam can be easily attended to by an operator, as the swing arm is easily removed. In this case, the movement detector is preferably activated when the swing arm is detached. Further, the embodiment can include a controller, the controller prohibiting operation of the imaging means, the sheet feeder, and the fixing unit when the swing arm is detached.

DETAILED DESCRIPTION OF THE PREFERRED EMBODIMENTS

Figure 1:
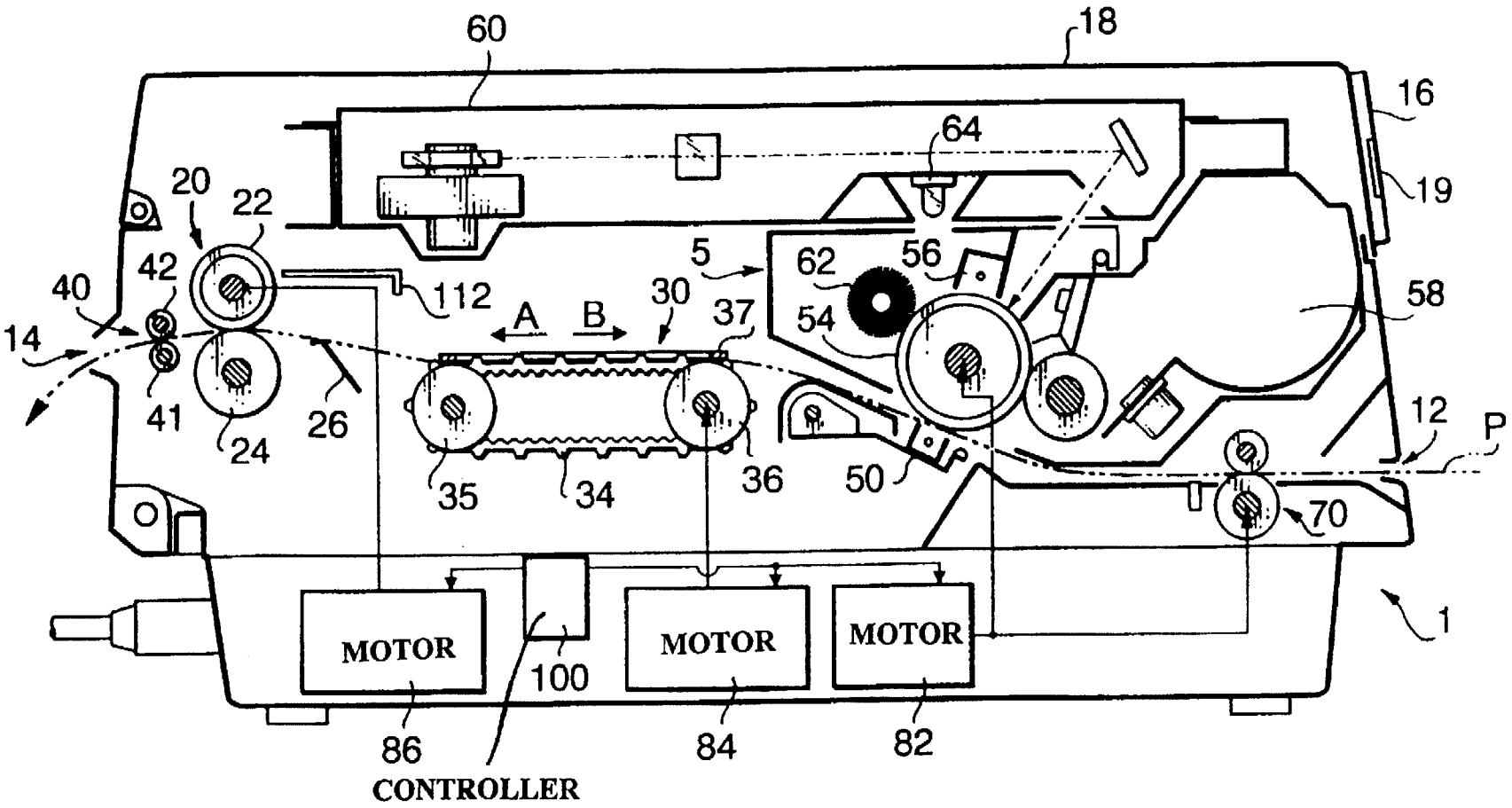
FIG. 1 is a side schematic view showing an electrophotographic printer according to the present invention.

FIG. 1 is a side schematic view showing an electrophotographic printer 1 according to preferred embodiment of the invention. A continuous form P, having feeding holes along both lateral sides of the form P, and perforations for separating discrete pages of the form, is employed as a recording sheet in the electrophotographic printer 1. The continuous form P (shown by a double-dotted line in FIG. 1) is transferred along a transport path between a sheet inlet 12 and a sheet outlet 14.

The electrophotographic process is carried out by a process unit 5 including a photoconductive drum 54, a developing unit 58, a cleaning brush 62, a discharging lamp 64, and a charging station 56. A transfer unit 50 and a laser scanning unit 60 also participate in the electrophotographic process.

Along the transport path from the inlet 12, the transfer unit 50 for transferring a toner image onto the form P, a tractor unit 30 for regulating the feed of the form P, a fixing unit 20 for fusing the toner image onto the form P, and a discharge roller pair 40 for discharging the form P from the printer 1 are arranged in that order. The transfer of the image from the drum 54 to the form P takes place at the transfer unit 50.

A back tension roller pair 70 is provided in the vicinity of the inlet 12 for applying tension to the form P. During the feeding of the continuous form P, the back tension roller pair 70 is always rotated to urge the form P in the reverse direction to maintain tension. When the form P is fed in a forward direction, the back tension roller pair 70 slips on the surface of the continuous form P to apply a tension thereto. When the continuous form P is fed in a reverse direction, the back tension roller pair 70 feeds the paper in the reverse direction in cooperation with the tractor unit 30.

A laser beam modulated in accordance with an image signal is projected from the laser scanning unit 60 (scanning in a main scanning direction), and is directed to the rotating (subscanning) photoconductive drum 54. The photoconductive drum 54 is driven at a constant speed via a gear train (not shown) by a motor 82. The photoconductive surface of the drum 54 is uniformly charged at the charging station 56, and when the surface is exposed to the laser beam, a latent image is formed thereon. Toner is adhered to the latent image by a developing unit 58 to form a toner image. The toner image is transferred onto the recording sheet (form P) by discharging at the transfer unit 50. The form bearing the toner image is transported downstream, and is fixed by a fixing unit 20, completing the printing for that image.

Any toner remaining on the surface of the drum 54 (after transfer of the toner image to the form P) is removed by the cleaning brush 62. Furthermore, any remaining charge on the surface of the photoconductive drum 54 is discharged at the discharging lamp 64 in preparation for the next image formation.

The tractor unit 30 is provided with a front pulley 35, a drive pulley 36, and an endless tractor belt 34 (having tractor pins for engaging the feeding holes of the form P). A belt 34 and pulleys 35, 36 are provided on each lateral side of the transport path. The drive pulley 36 is driven by a stepping motor 84 via a gear train (not shown), and is drivable in both forward (arrow A in FIG. 1) and reverse (arrow B in FIG. 1) directions. The motor 84 is a stepping motor, and is controlled to drive the tractor 30 at a constant speed in an open loop system.

The fixing unit 20 comprises a heat roller 22 and a pressure roller 24, and the discharge roller pair 40 comprises an upper roller 42 and a lower roller 41. The members and rollers of the fixing unit are supported by a frame 120 (shown in FIGS. 3 and 4). The heat roller 22 and lower discharge roller 41 are driven by a motor 86 via a gear train 86*a* (shoe in FIG. 3). The pressure roller 24 and upper discharge roller 42 are retractable by a retracting mechanism (not shown) from an operating position to a retracted position. In the operating position, the pressure roller 24 presses the form P against the heat roller 22 and the upper discharge roller 42 presses the form P against the lower discharge roller 41. In the retracted position, the pressure roller 24 and upper discharge roller 42 are moved away from their respective facing rollers and away from contact with the form P.

The motor 86 for driving the heat roller 22 and the lower discharge roller 41 is a stepping motor, and drives the lower discharge roller 41 to feed the form P slightly faster (by a predetermined amount) than the tractor 30. As the tractor 30 and the form P are positively engaged and the tractor 30 being driven at a constant speed, the continuous form P is fed at a constant speed under a controlled tension.

Figure 4:
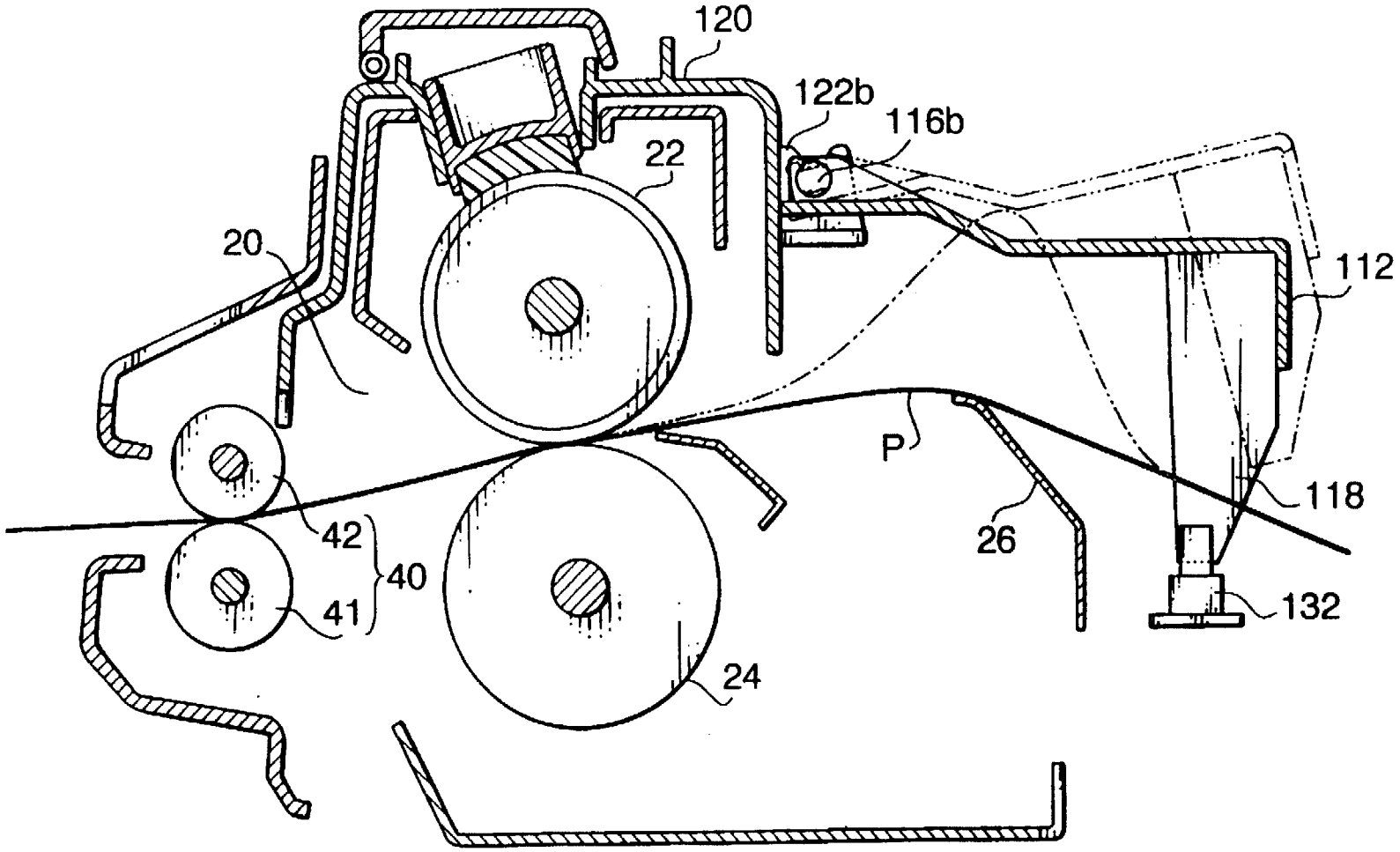
FIG. 4 is a side sectional view, taken along section IV—IV of FIG. 3, showing alternate positions of the jam detector.

As shown in FIGS. 1 and 4, a swingable speed control plate 26 contacts a lower surface of the continuous form P along the sheet transport path between the tractor unit 30 and the fixing unit 20. The speed control plate is biased upward by a spring (not shown), and the inclination of the speed control plate 26 varies depending on the tension applied to the continuous form. The inclination of the speed control plate 26 is detected by a sensor (not shown) and the driving speed of the motor 86 is controlled so that the inclination of the speed control plate 26 is maintained in a predetermined range. That is, the motor 86 controls the driving speed of the heat roller 22 and the lower roller so that the tension of the continuous form P between the tractor unit 30 and the fixing unit 20 always falls in a predetermined range.

In order to place a continuous form P into the printer 1, the continuous form P is led in through the inlet 12. The continuous form P is then clamped between the tractor belts 34 and corresponding tractor guide members 37 provided in the area of the tractor unit 30. The tractor guide members 37 are parallel to the tractor belts, and include a groove through which the tractor pins may pass.

The continuous form P is then advanced, fed only by the tractor 30. Then, when the leading end of the continuous form P reaches the discharge roller pair 40, the continuous form P is nipped and pulled by the discharge roller pair at a speed held constant by tractor 30.

However, if the form P is jammed at any point between the tractor unit 30 and the fixing unit 20, the continuous form P can buckle, and bulge above the sheet transport path. In this area, the continuous form P is steadily biased upwardly by the speed control plate 26 to control the tension of the continuous form P. Accordingly, during the feeding of the continuous form P, if the continuous form P is unable to pass between the heat roller 22 and the press roller 24, but the tractor unit 30 continues to drive, the continuous form P can buckle between the tractor unit 30 and fixing unit 20.

Figure 2:
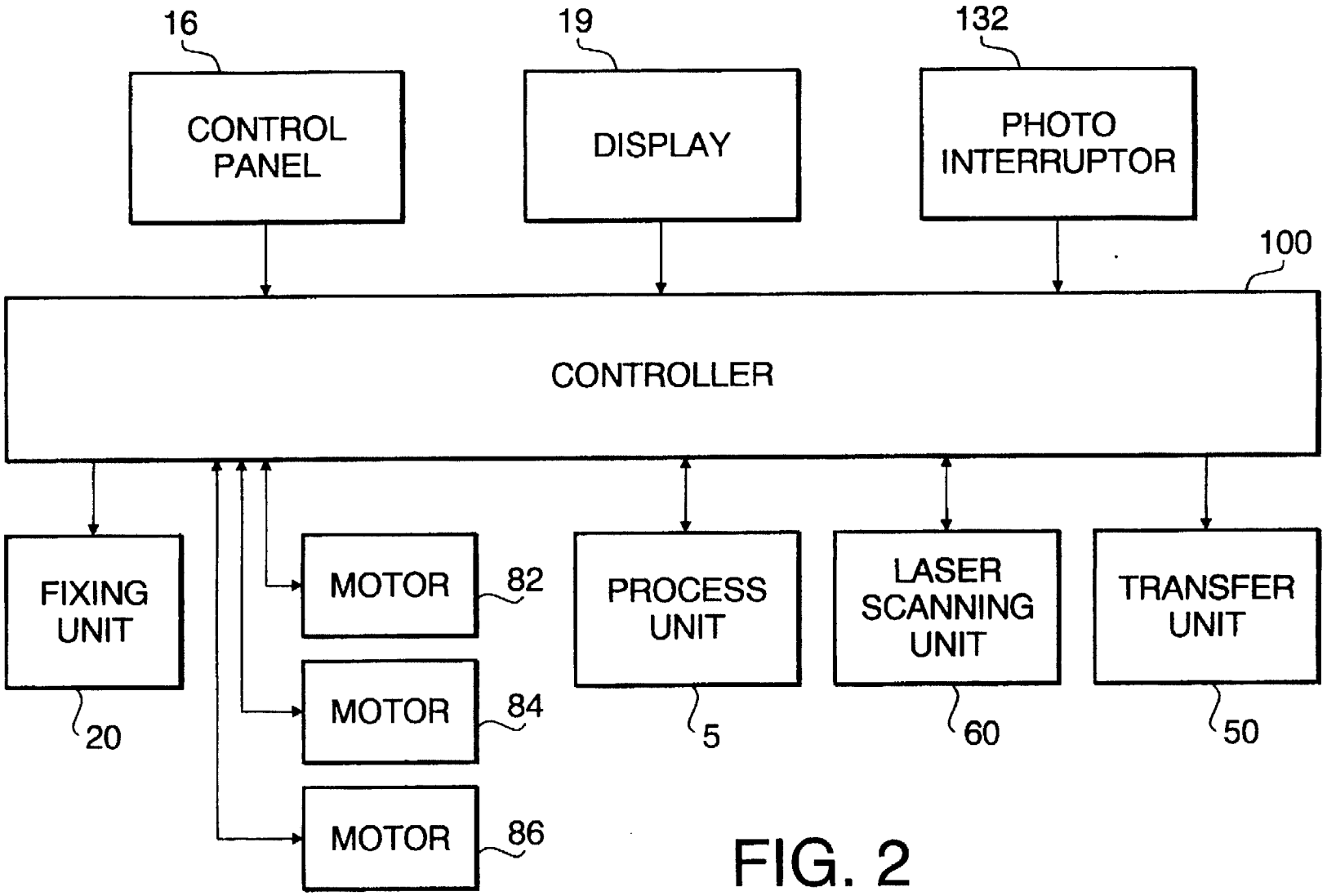
FIG. 2 is a block diagram of a control system of the electrophotographic printer shown in FIG. 1.

FIG. 2 is a block diagram detailing the control system of the printer 1. Inputs to the controller 100 include a detection signal from a jam detector 110 (described below) and a control panel 16 provided on the exterior of the printer 1. A display 19 can display error codes and other messages. The controller 100 controls motors 82, 84, and 86. The controller also controls the fixing unit 20 (and thereby the discharge roller pair 40), and the transfer unit 50 to move each between an operating position and a retracted position depending on the direction of paper transport. Further, the controller 1 controls the elements of the electrophotographic process, including the laser scanning unit 60 and the process unit 5.

Figure 3:
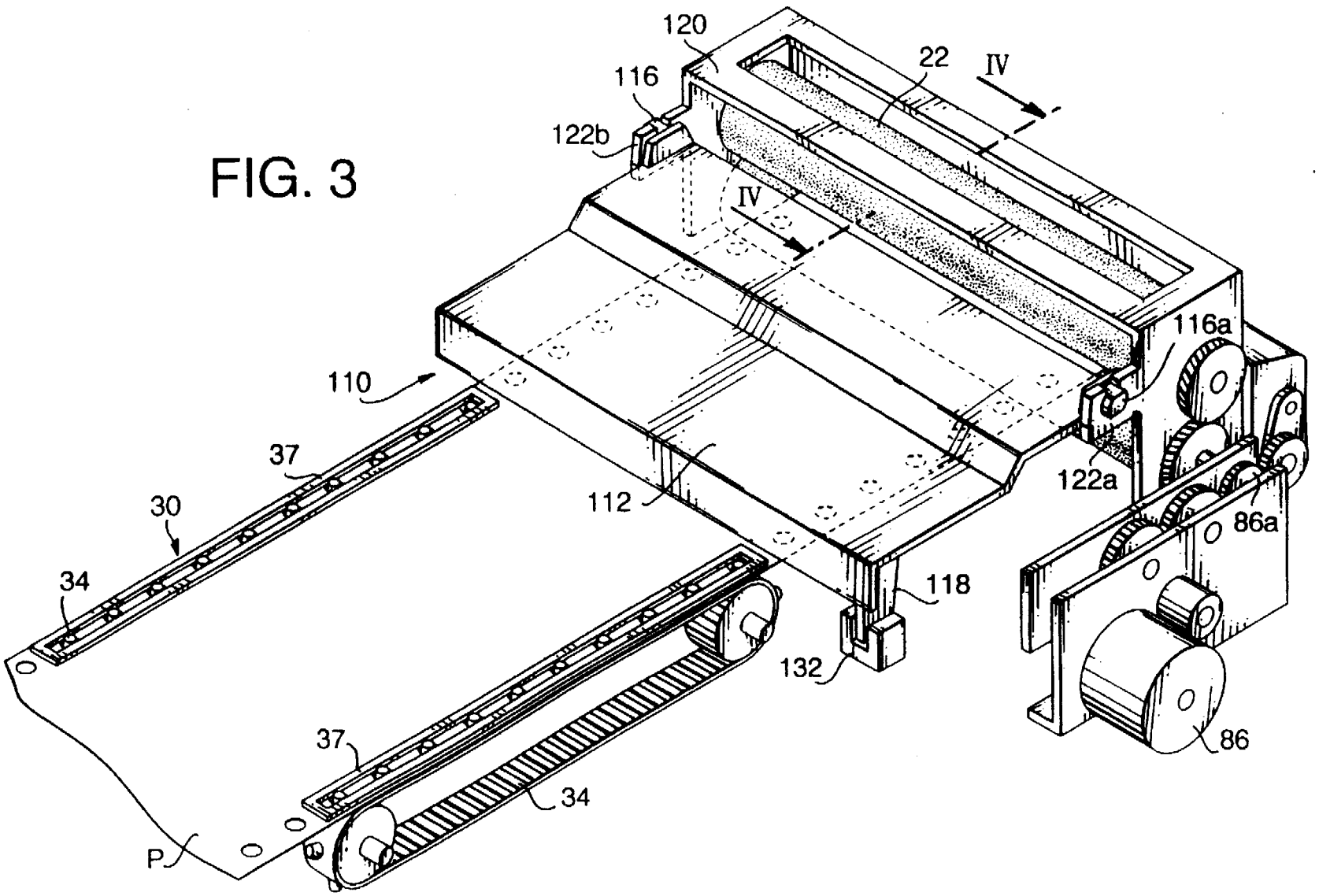
FIG. 3 is a perspective view of a sheet transport path, tractor, fixing unit, and jam detector of an electrophotographic printer according to the present invention.

FIG. 3 is a perspective view showing the sheet transport area between the tractor 30 and the fixing unit 20. A jam detector 110 extends between the fixing unit 20 and the tractor unit 30. In this embodiment, the jam detector 110 is associated with the fixing unit housing 120. The jam detector 110 is provided with a detection member, in this case a swing arm (cover am 112) that covers the form P. The cover arm 112 has a width substantially equal to the housing 120, and the cover am 112 extends along the sheet transport path from the fixing unit 20 toward the tractor unit 30. The cover arm 112 is positioned above the transport path of the continuous form P, and covers the entire width of the form P, extending past the form P on either lateral side.

The cover 112 is swingable at its axis end about two pivot shafts 116*a*, 116*b*, respectively supported by shaft holders 122*a*, 122*b* on the housing 120 of the fixing unit 20. Thus, the cover arm 112 is swingable relative to the sheet transport path, in this case about an axis end portion thereof on the fixing unit side. The supporting members 122*a*, 122*b* are C-shaped and open upwardly, while the pivot shafts 116*a*, 116*b* are flattened cylindrical shapes. The flattened sides of the pivot shafts are substantially parallel with the cover arm 112, and each pivot shaft is approximately the same width across the flattened cylindrical shape as the opening of the C-shapes of the supporting members 122*a*, 122*b*. Thus, the pivot shafts 116*a*, 116*b* can be removed from the C-shaped supporting members 122*a*, 122*b* by swinging the cover to a substantially vertical position, so that the cover 112 is detachable from the housing 120. However, while the cover is not vertical, the pivot shafts 116*a*, 116*b* are securely held in the supporting members 122*a*, 122*b*.

An actuator finger 118 is provided on the swinging end portion of the cover arm 112, on the tractor unit side. A finger detecting sensor, in this case a photointerruptor 132, is provided in a position to intercept the actuator finger 118 between the fixing unit 20 and the tractor unit 30. The photointerruptor 132 and actuator finger 118 together constitute a movement sensor. When the cover 112 is in a resting position, undisturbed by a buckling form caused by a paper jam, the actuator finger 118 interrupts the photointerruptor 132. This position of the cover arm 112 is shown in FIG. 3. When the cover 112 is moved by a paper jam loop, the actuator finger 118 is removed from the photointerruptor 132.

FIG. 4 is a side sectional view taken along section line IV—IV of FIG. 3, showing the jam detector 110 and fixing unit 20. In FIG. 4, the continuous form P and the cover arm 112 are shown by solid lines in an unjammed, normal feeding condition, and by a double-dotted line in one possible buckled and jammed condition. If the continuous form P jams at the fixing unit 20, the tractor 30 continues to feed the form P. Subsequently, the continuous form P buckles and bulges away from the form transport path between the fixing unit 20 and the tractor unit 30, contacting the cover arm 112 from the lower side, and pushes up the cover arm 112. When the cover arm 112 is pushed up, the actuator finger 118 leaves the photointerruptor 132, turning the photointerruptor 132 ON.

Since the cover arm 112 is arranged just above the transport path of the continuous form P, detection of a paper jam occurs very soon after the paper begins to buckle. Further, the cover 112 is wider than the continuous form P, so it detects buckling beginning on either lateral side of the transport path. Still further, the cover arm 112 extends almost all the way from the fixing unit 20 to the tractor unit 30, so the highest point of any buckle, or bulge in the paper, initiated by any jam therebetween will be detected early. The swinging cover arm 112 magnifies the extent of the amount that the actuator finger 118 is pushed up, so that even a small amount of buckling is sufficient for the actuator finger 118 to clear the photointerruptor 132.

When the actuator finger 118 leaves the photointerruptor 132, an ON signal from the photointerruptor 132 is input to the controller 100. In response to the ON signal from the photointerruptor 132, the controller 100 stops the motor 84, thereby stopping the tractor unit 30, and displays a jam error indication on the display portion 19 of the control panel 16. The controller 100 simultaneously operates the fixing unit 20 to separate the heat roller 22 and pressure roller 24 from one another and the discharge rollers 41, 42 from one another.

The controller 100 does not resume operation of printing until the jam condition is cleared. That is, as long as the photointerruptor 132 is in the ON condition, printing is not permitted by the controller 100. In order to free the continuous form P, the upper cover 18 of the printer 1 is opened. The cover arm 112 is then swung up and/or detached from the fixing unit housing 120. As the cover 112 can be easily detached, the freeing of a jammed continuous form P is easily accomplished. After a jammed form P is removed, by attaching and/or swinging down the cover 112, followed by the upper cover 18, operation of the printer 1 may be resumed.

At this time, unless the cover arm 112 (if removed) is reattached, the controller 1 does not allow the operation of the printer 1 to resume, as the photointerruptor 132 remains ON in such a case. Thus, the printer 1 cannot be operated without attaching and closing the cover arm 112.

Thus, according to a preferred embodiment of a paper jam detector as described, when a continuous form becomes jammed, the jam is detected early and removal of the continuous form is easy. Further, the printer cannot be operated without attaching and closing the cover arm. Two further benefits of the wide, plate-like cover arms described are that an operator is prevented from touching the heat roller from the tractor side, and that components on the tractor side such as the laser scanning unit and the tractor itself are protected from the heat of the heat roller.

The present disclosure relates to subject matter contained in Japanese Patent Application No. HEI 07-091459, filed on Mar. 25, 1995, which is expressly incorporated herein by reference in its entirety.

What is claimed is:

1. A jam detector for a sheet transport path of a continuous form electrophotographic printer, said jam detector comprising:

a detection member extending along the sheet transport path in a direction of sheet transport, said detection member positioned to be pushed away from the sheet transport path by buckling of the continuous form at substantially any position along said detection member; and a movement sensor for sensing movement of said detection member.

2. The jam detector according to claim 1, said detection member extending substantially parallel to the sheet transport path.

3. The jam detector according to claim 1, said movement sensor sensing movement of said detection member when only a portion of said detection member moves away from the sheet transport path.

4. The jam detector according to claim 1, said detection member being plate-shaped, and covering an entire width of the continuous form.

5. The jam detector according to claim 1, said detection member comprising:

a swing arm, swingable about a swinging axis, having an axis end and extending to a swinging end in a direction parallel to the sheet transport path, said swinging end being swingable away from the sheet transport path; said swing arm positioned to be pushed and swung away from the sheet transport path by buckling of the continuous form at any position from said swinging axis, along said swing arm, to said swinging end.

6. The jam detector according to claim 5, said swing arm being plate-shaped, and covering an entire width of the continuous form.

7. The jam detector according to claim 5, said movement sensor comprising:

an actuator finger attached to said swing arm and swingable with said swing arm; and a finger detector, activated by swinging of said actuator finger away from the sheet transport path.

8. The jam detector according to claim 5, said swing arm being detachably supported, and detachable from said jam detector when swung to a predetermined position.

9. The jam detector according to claim 8, said movement sensor being activated when said swing arm is detached.

10. A jam detector for a sheet transport path of a continuous form electrophotographic printer, said jam detector comprising:

a swing arm, swingable about a swinging axis, said swing arm having an axis end and extending to a swinging end in a direction parallel to the sheet transport path, said swinging end being swingable away from the sheet transport path;

an actuator finger attached to said swing arm and swingable with said swing arm; and a finger detector, activated by swinging of said actuator finger away from the sheet transport path;

said swing arm positioned to be pushed and swung away from the sheet transport path by buckling of the continuous form at any position from said swinging axis, along said swing arm, to said swinging end, thereby swinging said actuator finger and activating said finger detector.

11. The jam detector according to claim 10, said swing arm extending substantially parallel to the sheet transport path.

12. The jam detector according to claim 11, said swing arm being plate-shaped, and covering an entire width of a continuous form.

13. The jam detector according to claim 10, said swing arm being detachably supported, detachable at said axis end from said jam detector when swung to a predetermined position.

14. The jam detector according to claim 13, said finger detector being activated when said swing arm is detached.

15. A continuous form electrophotographic printer, comprising:

imaging means for forming a toner image on a continuous form;

a sheet feeder for feeding the continuous form along a sheet transport path;

a fixing unit for fixing the toner image to the continuous form;

a detection member extending along the sheet transport path from said fixing unit to said sheet feeder, said detection member being positioned to be pushed away from the sheet transport path by buckling of the continuous form at substantially any position along said detection member from said fixing unit to said sheet feeder; and a movement sensor for sensing movement of said detection member.

16. The printer according to claim 15, further comprising:

a controller, said controller stopping said sheet feeder and releasing the continuous form from said fixing Unit when said movement sensor senses movement of said detection member.

17. The printer according to claim 15, said detection member extending substantially parallel to the sheet transport path.

18. The printer according to claim 15, said movement sensor sensing movement of said detection member when only a portion of said detection member moves away from the sheet transport path.

19. The printer according to claim 15, said detection member being plate shaped, and covering an entire width of the continuous form.

20. The printer according to claim 15, said detection member comprising:

a swing arm swingable about a swinging axis having an axis end and extending to a swinging end in a direction parallel to the sheet transport path, said swinging end being swingable away from the sheet transport path; said swing arm swinging in response to loop formation in said continuous form at any position from said swinging axis along said swing arm to said swinging end.

21. The printer according to claim 20, said swing arm extending substantially parallel to the sheet transport path.

22. The printer according to claim 20, said swing arm being plate-shaped, and covering an entire width of the continuous form.

23. The printer according to claim 20, said movement sensor comprising:

an actuator finger attached to said swing arm and swingable with said swing arm; and a finger detector, activated by swinging of said actuator finger away from the sheet transport path.

24. The printer according to claim 23, said swing arm being detachably supported, and detachable from said printer when swung to a predetermined position.

25. The printer according to claim 24, said finger detector being activated when said swing arm is detached.

26. The printer according to claim 25, further comprising:

a controller, said controller prohibiting operation of said imaging means, said sheet feeder, and said fixing unit when said swing arm is detached.

27. A continuous form electrophotographic printer, comprising:

imaging means for forming a toner image on a continuous form;

a fixing unit for fixing the toner image to the continuous form;

a sheet feeder for feeding the continuous form along a sheet transport path extending from said imaging means to said fixing unit;

a swing arm, swingable away from the sheet transport path about an axis supported by said fixing unit, and extending substantially to said sheet feeder, said swing arm being positioned to be pushed away from the sheet transport path by buckling of the continuous form at any position from said axis, along the sheet transport path, to said sheet feeder;

an actuator finger attached to said swing arm and swingable about said swing arm; and a movement detector, activated by swinging of said actuator finger away from the sheet transport path.

28. The printer according to claim 27, further comprising:

a controller, said controller stopping said sheet feeder and releasing the continuous form from said fixing unit when said movement detector senses movement of said actuator finger.

29. The printer according to claim 27, said swing arm extending substantially parallel to the sheet transport path.

30. The printer according to claim 27, said swing arm being plate-shaped, and covering an entire width of the continuous form.

31. The printer according to claim 27, said swing arm being detachably supported, detachable at said axis from said printer when swung to a predetermined position.

32. The printer according to claim 31, said movement detector being activated when said swing arm is detached.

33. The printer according to claim 27, further comprising:

a controller, said controller prohibiting operation of said imaging means, said sheet feeder, and said fixing unit when said swing arm is detached.

* * * * *